United States Patent [19]

Howard et al.

[11] Patent Number: 4,762,235

[45] Date of Patent: Aug. 9, 1988

[54] INTEGRATED MODULAR STORE FIXTURE SYSTEM AND A TRAY AND HEADER THEREFOR

[75] Inventors: Fred Howard, New York; Sydney Edson, East Meadow, both of N.Y.

[73] Assignee: Sara Lee Corporation, Winston-Salem, N.C.

[21] Appl. No.: 883,586

[22] Filed: Jul. 9, 1986

[51] Int. Cl.[4] ..... A47F 5/00

[52] U.S. Cl. ..... 211/59.3; 40/651; 108/109; 211/126; 211/187; 211/193

[58] Field of Search ..... 211/59.2, 59.3, 57.1, 211/59.1, 126, 189, 193, 90, 187, 183; 108/108, 109; 40/12, 16.4

[56] References Cited

U.S. PATENT DOCUMENTS

| | | | |
|---|---|---|---|
| 3,359,664 | 12/1967 | Bell | 40/16.4 |
| 3,993,002 | 11/1976 | Stroh | 108/108 |
| 4,274,687 | 6/1981 | Bayles et al. | 211/126 X |
| 4,611,866 | 9/1986 | Everett | 211/189 X |

FOREIGN PATENT DOCUMENTS

| | | | |
|---|---|---|---|
| 1322088 | 2/1963 | France | 108/109 |
| 2329234 | 5/1977 | France | 108/108 |
| 328373 | 4/1958 | Switzerland | 108/108 |
| 1068579 | 5/1967 | United Kingdom | 211/90 |

*Primary Examiner*—Robert W. Gibson, Jr.
*Attorney, Agent, or Firm*—McAulay, Fields, Fisher, Goldstein & Nissen

[57] ABSTRACT

An integrated modular store fixture system provided with a plurality of C-shaped rigid frame members, each having two horizontal arms and a vertical spine connecting the two arms and disposed at a rear portion of the unit and a plurality of rigid spacer elements connecting the frame members together in a spaced apart parallel relationship. A plurality of trays for holding merchandise to be displayed are releasably mounted between successive spines.

24 Claims, 5 Drawing Sheets

INTEGRATED MODULAR STORE FIXTURE SYSTEM AND A TRAY AND HEADER THEREFOR

BACKGROUND OF THE INVENTION

The present invention relates to a modular store fixture system designed to display packaged goods in multiple sections, each having a plurality of trays or other means to store and dispense products on display.

Store fixture systems are known wherein products to be sold are held on trays, shelves or other means, which are mounted on fixture rails in the fixture. Because of the design of the prior art systems, they are restricted in the size and type of the trays to be used and limited in the vertical spacing between trays, so that there is difficulty in accommodating different size packages.

These shortcomings are particular problematic in the display of hosiery, where there are at least four different types of packages—different in thickness, in height and in width. J-board packaging is 8" wide×9½" high; popular pouch packs are 5" wide×5" high; narrow packs are 3½" to 4" wide and 9" to 9½" high; and spaghetti boxes are 2½" wide×9" wide.

Once these prior art store fixture systems are assembled and the trays are set into place, the dimensions of the tray, the spacing between the trays, etc., cannot be changed so that if one product of a particular size is selling better than another product with a different size package, it is not possible to stock the trays with the different size package, due to the above-mentioned shortcomings of the system.

Thus it is desirable to achieve a product presentation where inventory and facings are based on rate of sale, simultaneously affording the retailer much freedom to effect changes quickly despite the fact that product size and shapes are different. This makes for better management of a category.

SUMMARY OF THE INVENTION

The main object of the present invention is to provide a modular store fixture system which overcomes the disadvantages of the prior art and which enables a product presentation based on the rate of sale, making for better management of the category.

In accordance with the invention, a modular store fixture system is provided with a plurality of C-shaped rigid frame members each having two horizontal arms and a vertical spine connecting the two arms. A plurality of rigid spacer elements connects the frame members together in a spaced apart parallel relationship, trays for holding merchandise to be displayed and means for releasably mounting the trays between successive spines.

In a particularly advantageous embodiment, each of the spines comprises a tubular member having a rectangular cross section and including a front surface, a rear surface and two side surfaces and wherein the means releasably mounting the trays comprises a series of aligned holes in the tubular members along both side surfaces and wherein each tray has a rear wall and two side walls and means projecting from the side walls for coacting with aligned holes in two successive spines to mount the tray in place. The holes are preferably spaced apart at a center-to-center distance of one-half inch.

The connecting members are configured to enable the system to have a given unit length of 8", that is the center-to-center spacings between successive frame members are multiples of 8", i.e., 16" and 24" and the trays have widths corresponding to these spacings. Thus the connecting members are 15" and 23" long to obtain the 16" and 24" spacings.

The tray in accordance with the present invention for displaying merchandise in the store fixture system comprises a base, a rear wall and two side walls and means projecting from the side walls for coacting with aligned holes in a displaying unit. Each tray preferably has means forming at least two parallel slots in the base extending from the front to the rear thereof, at least one divider wall centered between each pair of slots and parallel thereto and pushing means slidably connected in the slots for pushing displayed merchandise from the rear to the front of the tray display. Each tray has from 2 to 6 slots and from 1 to 5 divider walls to accommodate different width packages for the same tray width.

As indicated, the connecting members have as their given unit length 8", with preferred tray widths being 16". For the 16" trays, the 8" J-board hosiery packages can be mounted two across, the 5" pouch packs can be mounted three across, the 3½" packs can be mounted four across and the 2½" spaghetti boxes can be mounted six across.

The side walls of each tray have means forming a rectangular indentation at the rear wall including a side facing surface and a rear facing surface, and wherein the means coacting with the holes project from the side facing surfaces. The means coacting with the holes comprises a screw extending through each side facing surface and means mounting the screw for rotation to engage a hole and to simultaneously force the tray rearwardly.

Means mounting the screw for rotation includes spring means urging each screw outwardly of the side facing surface while permitting movement in the opposite direction in response to manual force exerted on the screw. Further, each screw is tapered downwardly at the projecting end thereof; and means mounting the screw comprises means disposing the center of the screw at a distance from the rear facing surface which is less than the distance of the center of the spine holes to the front surface thereof.

As a result of this structure, the mounting screws can be pulled inwardly to enable the tray to slide between the frame spines and allow the screws to initially snap into the holes to hold the tray in place while the screws are tightened. The tightening of the screws moves the surfaces of the tray into the spine while simultaneously moving the tray rearwardly so as to make a rigid connection and prevent any desirable rattling of the tray when mounted in place in the frame.

Because of the unique mounting scheme in accordance with the present invention, the holes in the spines can be one-half inch on center or closer, which allows smaller spacing than in prior art store fixture systems and therefore allows much greater degree of vertical adjustment when mounting the trays.

The display header for the store fixture system, in accordance with the invention, has at least one header unit having front and rear surfaces and means defining a display channel on the front surface for slidably receiving a display card. Means defining an aligning channel is provided on the rear surface for slidably receiving an aligning member for aligning two adjacent header units.

Each header unit comprises elongated upper and lower header members, wherein the upper header member includes means forming a longitudinal connecting channel and wherein the lower header member has means forming a longitudinal connecting web slidably received in the connecting channel to connect the upper and lower header members with the upper header member disposed above the lower header member, and wherein the upper and lower header members have front and rear surfaces and means forming display channels on the front surfaces thereof and aligning channels on the rear surfaces thereof. The upper and lower header members are preferably each composed of extruded aluminum.

The lower header preferably comprises means forming a mounting surface configured to abut against a display unit surface and means mounting the display header comprising a clamp releasably fastenable to the display unit surface for engaging the header members to fix the lower header member in an abutting position against the display unit surface.

The header assembly is particularly advantageous since the headers can be attached to the frame in sections and can be advantageously aligned by use of the rear slots so that the cards disposed in the channels in the front surfaces of the header will be easily slid into place and the header will have a uniform appearance even though it is made out of several separate and unconnected lengths.

These and other objects and advantages of the present invention will be more completely disclosed with reference to the following detailed description taken with the attached drawings, wherein:

DETAILED DESCRIPTION OF THE INVENTION

Figure 1:
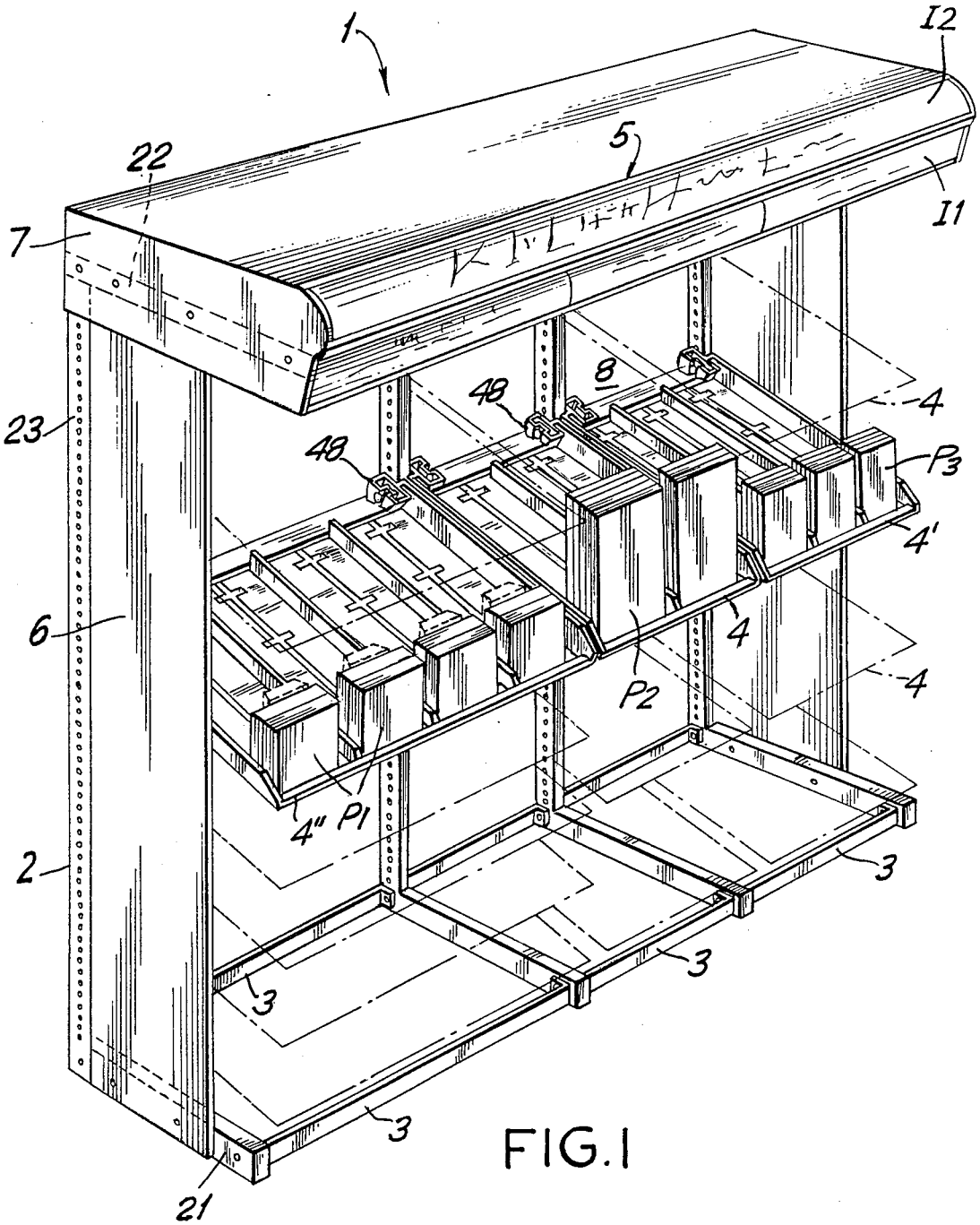
FIG. 1 is a perspective view of the integrated modular store fixture system according to the present invention.

Referring now to FIG. 1, the integrated modular store fixture system 1 in accordance with the present invention includes a plurality of C-shaped frame members 2 which include two horizontal arms 21 and 22 and a vertical spine 23 at a rear portion of the system. Successive frame members 2 are connected by means of four connecting members 3 at the free ends of both arms 21 and 22 and at the ends of spine 23 in order to fix the successive frame members in a spaced apart parallel relationship.

The C-shaped frame members are disclosed hereinafter in more detail with respect to FIG. 2 and the spacer elements are discussed in further detail hereinafter with regard to FIG. 3.

The integrated modular store fixture system 1 also includes a plurality of trays 4 for holding merchandise such as packages P1, P2 and P3 to be displayed. The trays, depending upon the size of the packages to be displayed, are disposed at different vertical spacings and include means for releasably mounting the trays 4 between successive spines 23 as will be disclosed hereinafter with regard to FIGS. 5–8.

Also included in the system is a display header assembly 5 which is used to hold brand information cards I1 in the lower portion thereof and store information cards I2 in the upper portion thereof. The details of the header unit will be described hereinafter with regard to FIG. 4.

The system also may include side panels 6, header side panels 7 and the rear panel 8 for closing off the unit and to provide it with a more attractive appearance.

Figure 2:
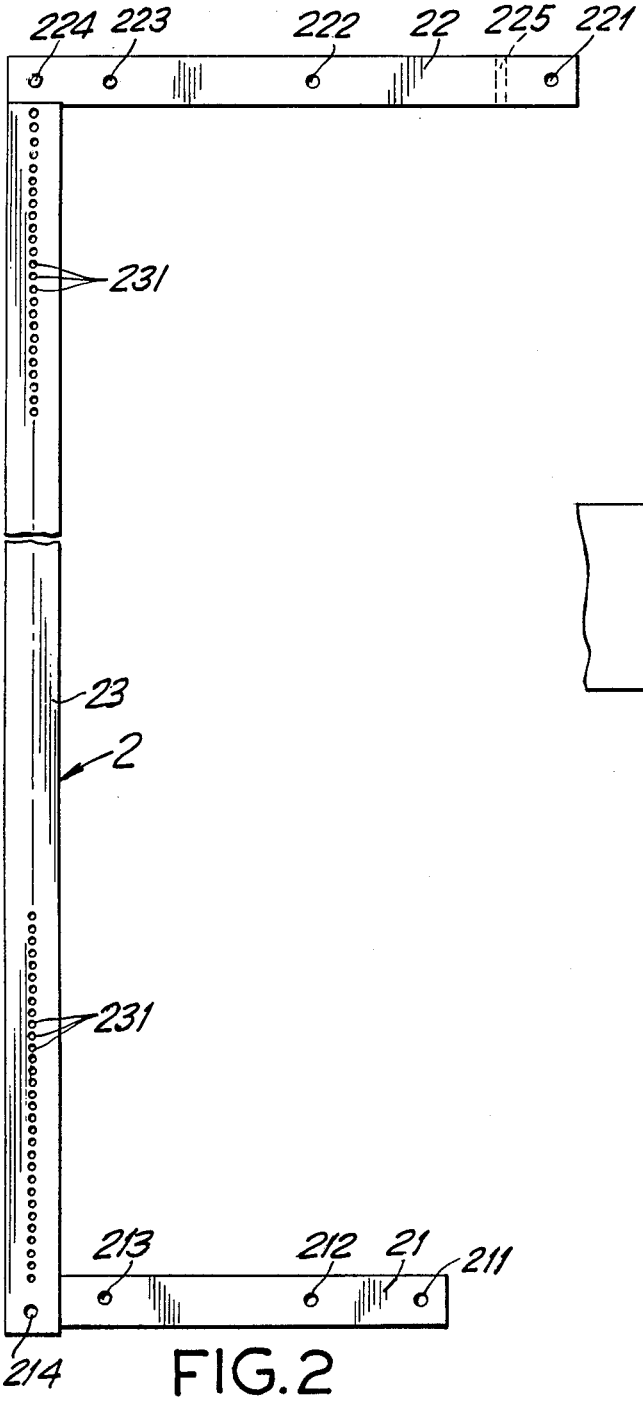
FIG. 2 is a side view of the C-shaped frame member according to the present invention.

FIG. 2 shows a side view of the C-shaped rigid frame member 2 in accordance with the present invention. The frame member 2 is preferably made from a tubular steel having a rectangular cross section with dimensions of preferably 1" by 2". The upper arm is approximately 22¼" in length, the lower arm is approximately 19½" in length and the spine is approximately 71" in length.

Disposed along spine 23 is a series of holes 231 having a diameter of approximately 3/16" and disposed at half inch centers.

Upper arm 22 includes holes 221 and 224 for the mounting of the rigid spacing members and holes 222 and 223 for attaching side panel 7. Likewise, lower arm 21 has holes 211 and 214 for the spacing elements 3 and holes 212 and 213 for the attaching side panel 7. Upper arm 22 also includes through hole 225 for use in connecting the header as will be explained hereinafter.

Figure 3A:
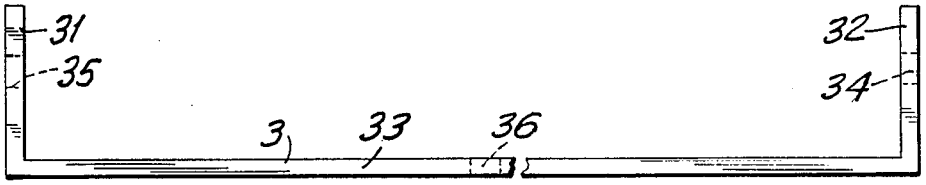
FIG. 3*a* and FIG. 3*b* are side and end views of the connecting member according to the present invention.
Figure 3B:
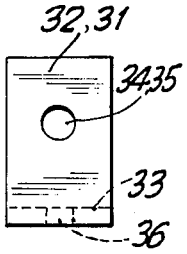

The rigid spacing element 3 is shown in more detail in FIGS. 3*a* and 3*b*.

Preferably, the spacing member comes in two sizes, a length of 15" and a length of 23" to obtain center-to-center spacings which are multiples of the modular unit length of 8". The spacer element 3 includes a middle portion 33 with mounting hole 36 and two end portions 31 and 32 with mounting holes 34 and 35 for connecting by means of bolts (not shown) to holes 221, 224, 211 and 214 of frame members 2.

Figure 8:
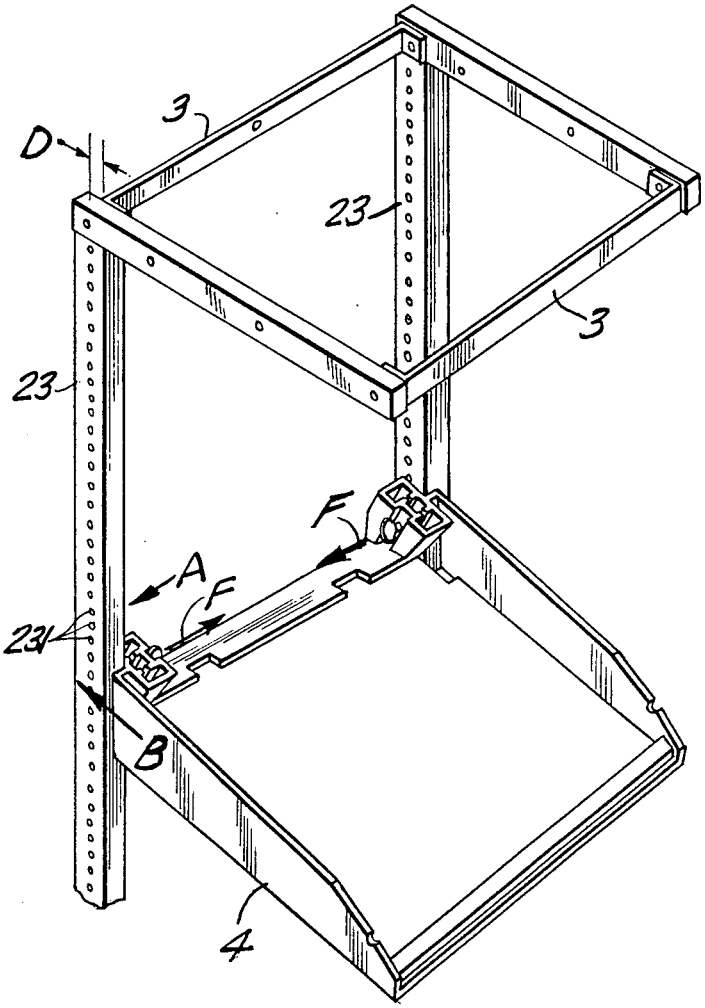
FIG. 8 is a perspective view showing the attachment of the tray in accordance with the present invention.

The interconnecting of frame members with four spacer elements can be seen from FIGS. 1 and 8 which show the connection of the bottom two and top two spacers respectively.

Figure 4:
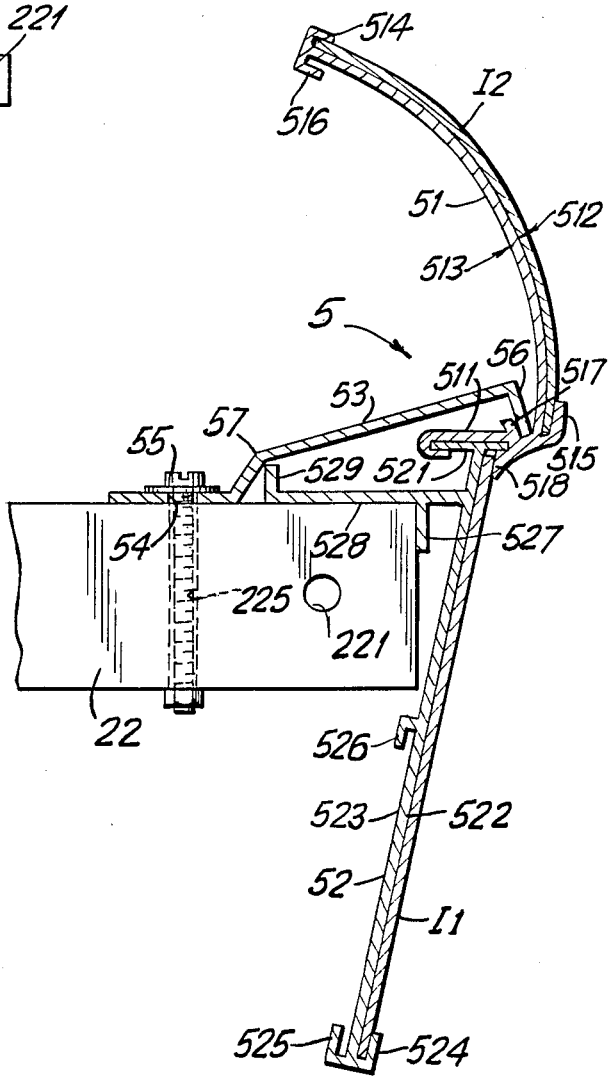
FIG. 4 is a sectional view of the display header in accordance with the present invention.

FIG. 4 illustrates the display header unit 5 according to the present invention.

The header unit 5 is constructed from an upper header member 51 and a lower header member 52. Upper header member 51 includes a longitudinal connecting channel 511 and lower header member 52 has a longitudinal connecting web 521 which is slidably received in the connecting channel 511 as shown to connect the upper and lower header members 51 and 52 with the upper header member disposed above the lower header member as shown.

The upper header member 51 has a front surface 512 and a rear surface 513 with channel forming members 514 and 515 forming a channel on the front surface 512 for receiving a display card I2 and channel forming members 516, 517 on the rear surface 513 for forming an alignment channel which will be described hereinafter.

Lower header member 52 has a front surface 522 and a rear surface 523 and includes channel forming members 524 which, with member 518 on upper header member 51, form a display channel at the front surface 522 receptive of display card I1 and has channel forming members 525 and 526 on the rear surface 523 thereof forming an aligning channel as will be described hereinafter.

When the system shown in FIG. 1 has a long length of, for example, more than 5 feet, it is desirable for the header assembly to be made from a number of sections rather than being one long piece. The problem that has always existed with headers of this type was that when they were made from various sections, they could not be properly aligned when mounted to the system so as to have an attractive appearance. By providing the aligning channels at rear surfaces 513 and 523, one can slide a card through the channels so that the aligning channels for adjacent display header sections can be aligned while being mounted into place so that the front channels will be also suitably aligned for display cards I1 and I2. Thereafter, the aligning cards may be removed.

The upper and lower header members 51 and 52 are preferably made from extruded aluminum sections in accordance with a preferred embodiment of the present invention.

In order to mount the header unit to the frame member 2, a lower header member 52 has mounting surfaces 527 and 528 which are configured to abut against the surfaces of the upper arm 22 of a frame member 2. The header 5 is releasably held in place by a clamp 53 which has a hole 54 through which a screw 55 is extended. Screw 55 also extends through hole 225 and a nut is engaged thereon to hold the clamp in place. The clamp has a first portion 56 which mounts in the channel forming portion 517 and has a portion 57 which abuts against a mounting flange 529 on lower header member 52 so as to force the surfaces 527 and 528 into contact with the arm 22. As a result, the header is rigidly forced into place and can be removed by simply unfastening screw 55.

Referring now to FIGS. 5–8, the tray 4 in accordance with the present invention will be disclosed in more detail.

The tray 4 has a base 41, side walls 42 and 43 and a rear wall 44. Disposed in base 41 are two longitudinal slots 411 and 412 which are separated by a divider wall 413. The slots are formed to receive an engaging portion 451 of pusher 45 which has a front surface 452 and a housing 453 which is filled with a heavy material such as sand. The element 451 is received in slots 411 and 412 and is used to push merchandise P1, P2, P3 forward to the front of the tray when the tray is mounted in place in the system 1. The tray may also include a conventional ticket channel at the front and a conventional clear front retainer to prevent packages from falling forward.

The mounting of the tray 4 between successive spines 23 by engaging holes 231 which are aligned in successive spines, is carried out by means including screw 46, spring 47 which are situated in housings 48 and 49 as will be described hereinafter. Side walls 42 and 43 have rectangular indentations 421 and 431 at the ends thereof adjacent the rear wall 44 and which have rear facing surfaces 422 and 432 and side facing surfaces 423 and 433.

Spring 47 includes a relatively straight portion 471 having a threaded member 472 mounted in an aperture 473 thereof and has two arcuate arms 474 and 475 terminating in a rounded portion 476 and 477. The spring is made of the spring metal or other suitable material.

Screw 46 is approximately 2" in length and has a head 461 which is configured to be turned by hand, a threaded portion 462 which is 13/16" in length and has a $\frac{1}{4}\times 20$ thread, a nonthreaded portion 463 which is about 3/16" in length and 3/16" in diameter and is thus of smaller diameter than threaded portion 462, and an end portion 464 which is about an $\frac{1}{8}$" in length and tapers down from a diameter of 3/16" to a point.

Figure 6:
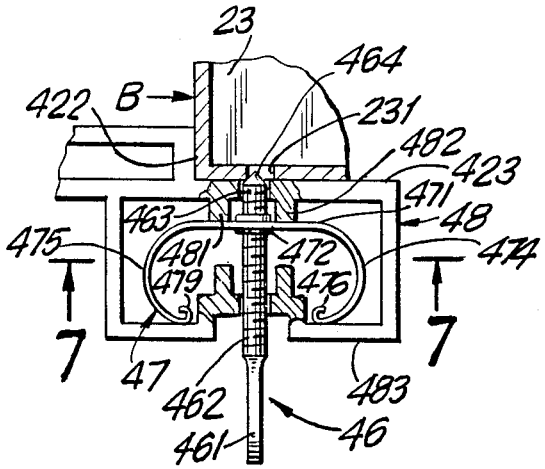
FIG. 6 is a top view of a detail of the tray shown in FIG. 5.
Figure 7:
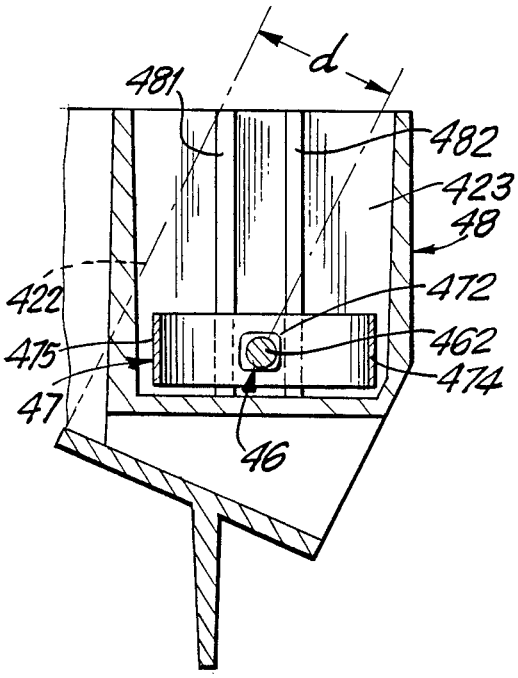
FIG. 7 is a sectional view of a detail of the tray shown in FIG. 6 along line VII—VII.

The mounting of the spring 47 and screw 46 in housing 48 and 49 is shown in more detail in FIGS. 6–8.

The screw 46 is threadably engaged with threaded member 472 of spring 47 as shown in FIG. 6 so that the tapered portion 464 of screw 46 protrudes outwardly from side facing surface 423 as shown. Spring 47 is seated in housing 48 (and similarly in housing 49, not shown) with ends 476 and 477 abutting wall 483 and portion 471 abutting projections 481 and 482.

Spring 47 is resilient and in response to an inwardly directed force F as shown in FIG. 8, spring 47 will deflect inwardly enabling screw portion 464 to be retracted until it is at least flush with side facing surface 423. In this manner, the tray 4 can be slid into place rearwardly while the inwardly directed force F is applied to screws 46. Upon reaching the desired position wherein screw 46 is alinged with the proper aligned holes 231 on spines 23, the screws are released and the portions 464 snap into holes 231 initially holding the tray in place for mounting. In this position, the tray can be vertically adjusted by merely again applying the inwardly directed forces F and moving the tray either vertically upwardly or downwardly and allowing the screws to snap into the desired aligned holes 231.

When the desired position of the tray is obtained, screw 46 is rotated by means of head 461.

As shown in FIG. 6, screw 46 is mounted to be slighly off center from the center of holes 231. That is, screw 461 is mounted so that the distance d between the axis of screw 46 and rear facing surface 422 is slightly less than the distance D between the center of holes 231 and the forward facing edge of spine 23. This difference is approximately 1/16" to 1/32" and preferably 1/32".

As a result of the mounting of the screw off center with the difference between the distances D and d, as screw 46 is tightened, side facing surface 423 moves into the side surface of spine 23 in the direction of arrow A in FIG. 8 while simultaneously the tray is moved rearwardly so that the rear facing surface 422 moves towards the front facing surface of spine 23 as shown by arrow B in FIG. 8. This results in a snug fit and prevents the tray from rattling after it is mounted in place. Moreover, added strength is given to the mounting despite the fact that the tray is made out of plastic material.

Figure 5:
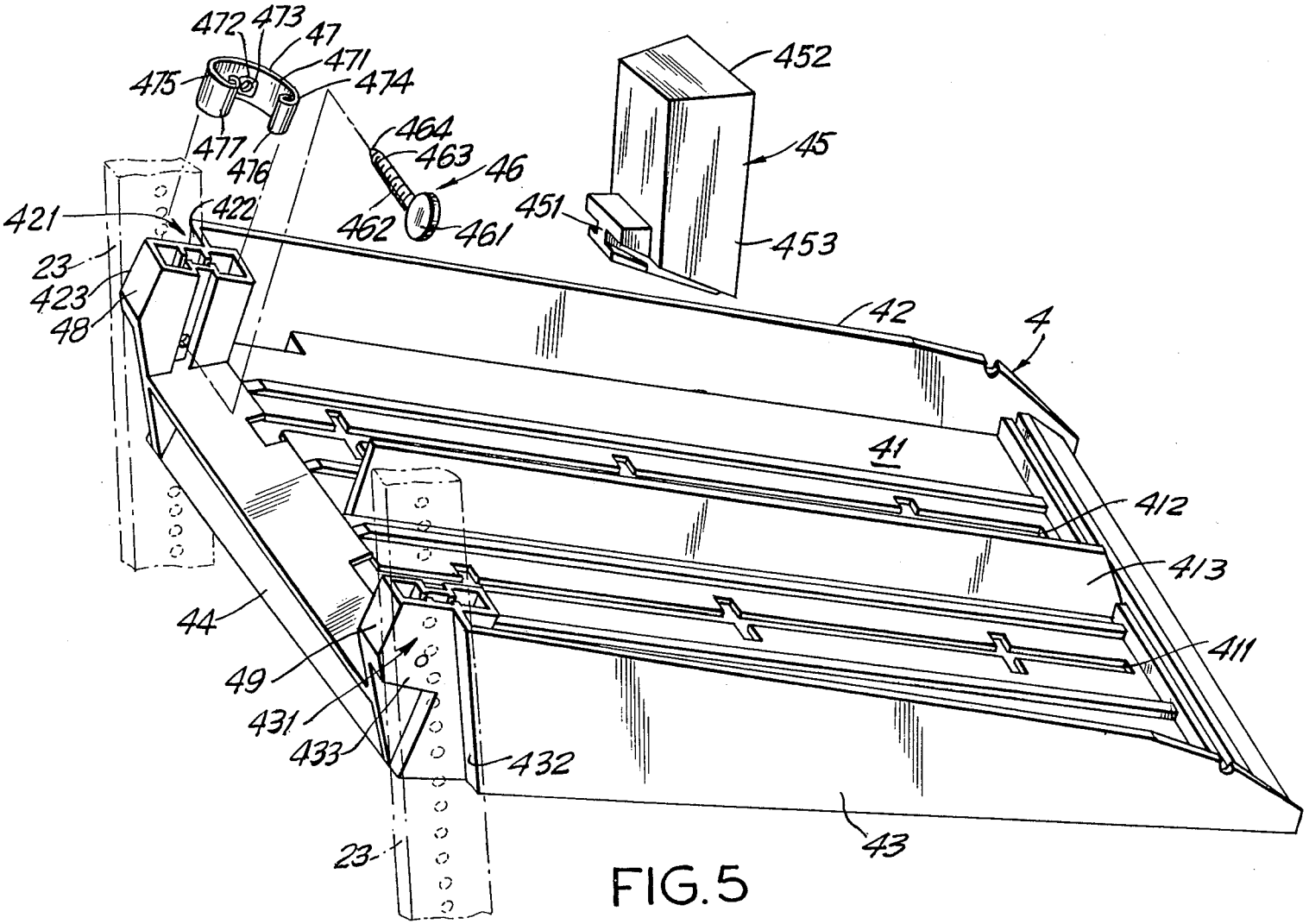
FIG. 5 is an exploded perspective view of the tray in accordance with the present invention.
Figure 9:
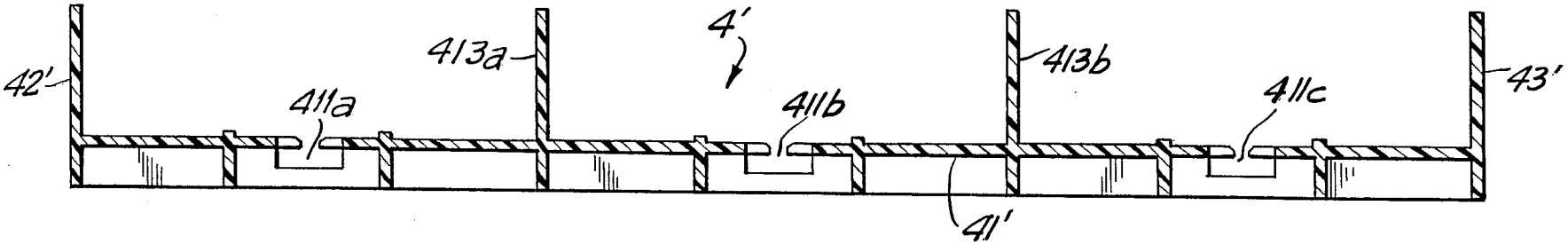
FIG. 9 is a sectional view of a three slide tray according to the present invention.
Figure 10:
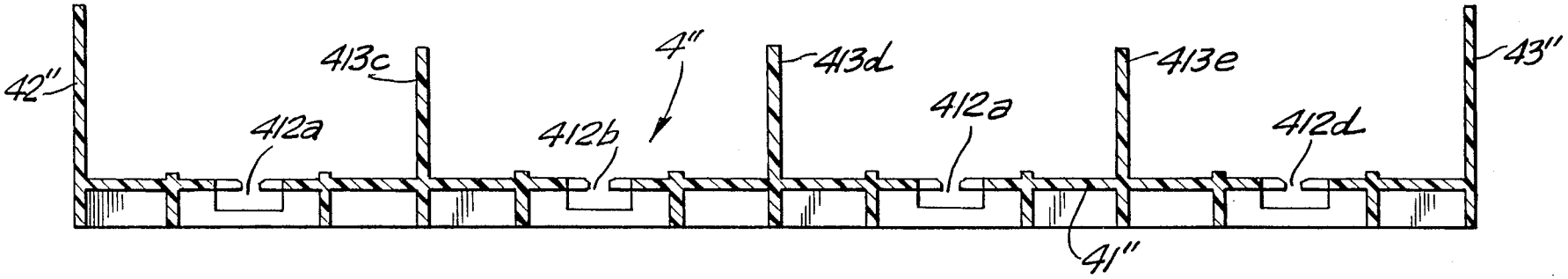
FIG. 10 is a sectional view of a four slide tray in accordance with the present invention.

FIGS. 9 and 10 show alternate forms of trays, that is, trays 4' and 4" having three and four slide sections respectively instead of the two section tray shown in FIG. 5. In FIG. 9, the three section tray has slots **411*a*–411*c* and dividers 413*a* and 413*b* between side walls 42' and 43' and projecting upwardly from base 41'. In FIG. 10, the four slide tray 4' has four slots 412*a*–412*d* and three dividers 413*c*–413*e* between side walls 42", 43" and extending upwardly from base 41"**.

It will be appreciated that the instant specification and claims are set forth by way of illustration and not limitation, and that various modifications and changes may be made without departing from the spirit and scope of the present invention.

What is claimed is:

1. An integrated modular store fixture system comprising:

a plurality of C-shaped rigid frame members each having an upper and a lower horizontal arm and a vertical spine connecting the two arms and disposed at a rear portion of the system;

a plurality of rigid spacer elements positioned adjacent each end of each of said upper and lower horizontal arms and connecting the frame members together in a spaced apart parallel relationship;

trays for holding merchandise to be displayed;

means for releasably mounting the trays between successive spines; and side panels connected to said frame members.

2. An integrated modular store fixture system according to claim 1, wherein each of the spines comprises a tubular member having a rectangular cross section and including a front surface, a rear surface and two side surfaces, and wherein the means releasably mounting the trays comprises a series of aligned holes in the tubular members along both side surfaces, and wherein each tray has a rear wall and two side walls and mounting means projecting from the side walls for coacting with aligned holes in two successive spines to mount the tray in place, and a recess defined by adjacent walls on said tray, said mounting means being located between the upper and lower edges of said walls defining said recess, at least one of said recess walls engaging the front surface of said spine to prevent pivotal movement of said shelf about said mounting means.

3. An integrated modular store fixture system according to claim 2, wherein the holes are spaced apart at a center-to-center distance of one-half inch.

4. An integrated modular store fixture system according to claim 1, wherein the connecting members have a length to effect different spacings between successive frame members which are in integral multiple of a given unit length and wherein the trays have widths corresponding to a multiple of the given unit length.

5. An integrated modular store fixture system comprising: a plurality of C-shaped rigid frame members each having two horizontal arms and a vertical spine connecting the two arms and disposed at a rear portion of the system; a plurality of rigid spacer elements connecting the frame members together in a spaced apart parallel relationship; trays for holding merchandise to be displayed; and means for releasably mounting the trays between successive spines; and wherein each tray has a front, a rear, two side walls, means forming at least two parallel slots extending from the front to the rear thereof, at least one divider wall centered between each pair of slots and parallel thereto and pushing means slidably connected in the slots for pushing displayed merchandise from the rear to the front of the tray during use.

6. An integrated modular store fixture system according to claim 5, wherein each tray has from 2 to 7 slots and from 1 to 6 divider walls to accommodate different width packages for the same tray width.

7. An integrated modular store fixture system comprising: a plurality of C-shaped rigid frame members each having an upper and a lower horizontal arm and a vertical spine connecting the two arms and disposed at a rear portion of the system; a plurality of rigid spacer elements connecting the frame members together in a spaced apart parallel relationship; trays for holding merchandise to be displayed; and means for releasably mounting the trays between successive spines; and a display header and means mounting the header to at least said upper one of said horizontal arms of said frame member, wherein the display header comprises at least one header unit having front and rear surfaces, means defining a display channel on the front surface for slidably receiving a display, means defining an aligning channel on the rear surface for slidably receiving an aligning member for aligning two adjacent header units.

8. An integrated modular store fixture system according to claim 7, wherein each header unit comprises elongated upper and lower header members, wherein the upper header member includes means forming a longitudinal connecting channel and wherein the lower header member has means forming a longitudinal connecting web slidably received in the connecting channel to connect the upper and lower header member with the upper header member disposed above the lower header member, wherein the upper and lower header members have front and rear surfaces, means forming display channels on the front surfaces thereof, and aligning channels on the rear surfaces thereof.

9. An integrated modular store fixture system according to claim 7, wherein the upper and lower header members are each composed of extruded aluminum.

10. An integrated modular store fixture system according to claim 7, wherein the lower header comprises means forming a mounting surface configured to abut against the surface of the upper arm of the frame member, wherein the means mounting the display header to the frame member comprises a clamp releasably fastened to the upper arm and engaging the header members to fix the lower header member in its abutting position against the surface of the upper arm.

11. An integrated modular store fixture system according to claim 2, wherein the recess is positioned in the side walls of each tray and includes means forming a rectangular indentation at the rear wall including a side facing surface and a rear facing surface, said side facing surfaces spaced apart to enable the tray to be slidably received between successive spines and the rear facing surfaces are configured to contact the front surface of the spine, and wherein the means coacting with the holes project from the side facing surfaces.

12. An integrated modular store fixture system according to claim 11, wherein the means coacting with the holes comprises a screw extending through each side facing surface, and means mounting the screw for rotation to engage a hole and to simultaneously force the side and rear facing surfaces into the front and side surfaces of the spine.

13. An integrated modular store fixture system according to claim 12, wherein means mounting the screw for rotation includes spring means urging each screw outwardly of the side facing surface while permitting movement in the opposite direction in response to an inwardly directed manual force exerted on the screw.

14. An integrated modular store fixture system according to claim 13, wherein the screw is tapered downwardly at the projecting end thereof, and the means mounting the screw comprises means disposing the axis of the screw at a distance from the rear facing surface which is less than the distance from the center of the spine hole to the front surface of the spine.

15. A tray for displaying merchandise in a store fixture system, comprising: a base, a rear wall and two side walls and mounting means projecting from the side walls for coacting with aligned holes in a support displaying unit; said side walls each having a recess at the rear thereof defined by a first and second wall; said mounting means projecting from said first wall, and said second wall being oriented at a preselected angle with respect to said first wall and positioned to engage a complimentary formed wall in the support to prevent pivotal movement of said tray about said mounting means.

16. A tray for displaying merchandise in a store fixture system, comprising: a base, a rear wall and two side walls and mounting means projecting from the side wall for coacting with aligned holes in a support displaying unit; said tray having means forming at least two parallel slots in the base extending from the front to the rear thereof, at least one divider wall centered between each pair of slots and parallel thereto, and pushing means slidably connected in the slots for pushing displayed merchandise from the rear to the front of the tray display.

17. The tray according to claim 16, wherein said tray has from 2 to 6 slots and from 1 to 5 divider walls to accommodate different width packages for the same tray width.

18. A tray for displaying merchandise in a store fixture system, comprising: a base, a rear wall and two side walls and mounting means projecting from the side wall for coacting with aligned holes in a support displaying unit; said means coacting with the holes comprising a screw extending through each side facing surface and means mounting the screw for rotation to engage a hole and to simultaneously force the tray rearwardly.

19. The tray according to claim 18, wherein means mounting the screw for rotation includes spring means urging each screw outwardly of the side facing surface while permitting movement in the opposite direction in response to an inwardly directed manual force exerted on the screw.

20. The tray according to claim 18, wherein each screw is tapered downwardly at the projecting end thereof the means mounting the screw comprises means disposing the screw off center relative to the holes to be coacted with.

21. A display header for a store fixture system comprising: at least one header unit including a central web having front and rear surfaces and means defining a display channel on the front surface for slidably receiving a display card, and means defining an aligning channel on the rear surface for slidably receiving an aligning member for aligning two adjacent header units.

22. A display header for a store fixture system comprising: at least one header unit having front and rear surfaces and means defining a display channel on the front surface for slidably receiving a display card, and means defining an aligning channel on the rear surface for slidably receiving an aligning member for aligning two adjacent header units; said header unit comprising elongated upper and lower header members, wherein the upper header member includes means forming a longitudinal connecting channel, and wherein the lower header member has means forming a longitudinal connecting web slidably received in the connecting channel to connect the upper and lower header members with the upper header member disposed above the lower header member, wherein the upper and lower header members have front and rear surfaces and means forming display channels on the front surfaces thereof, and aligning channels on the rear surfaces thereof.

23. The display header according to claim 22, wherein the upper and lower header members are each composed of extruded aluminum.

24. The display header according to claim 22, wherein the lower header comprises means forming a mounting surface configured to abut against a support surface, and further comprising means mounting the display header to a support surface comprising a clamp releasably fastenable to the support surface for engaging the header members to fix the lower header member in an abutting position against the support surface.

* * * * *